US006360723B1

(12) United States Patent
Nomura

(10) Patent No.: US 6,360,723 B1
(45) Date of Patent: Mar. 26, 2002

(54) MOUNTING APPARATUS OF FUEL INJECTION VALVE

(75) Inventor: Kenichi Nomura, Yokohama (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/665,474

(22) Filed: Sep. 20, 2000

(30) Foreign Application Priority Data

Nov. 17, 1999 (JP) ..... 11-326838

(51) Int. Cl.[7] ..... F02M 33/04
(52) U.S. Cl. ..... 123/470; 123/468
(58) Field of Search ..... 123/456, 468, 123/469, 470

(56) References Cited

U.S. PATENT DOCUMENTS 4,991,557 A * 2/1991 Degrace ..... 123/470
5,136,999 A * 8/1992 Bassler ..... 123/470
5,520,151 A * 5/1996 Gras ..... 123/470
6,053,149 A * 4/2000 Lorraine ..... 123/470
6,227,169 B1 * 5/2001 Sato ..... 123/456

* cited by examiner

*Primary Examiner*—Thomas N. Moulis
(74) *Attorney, Agent, or Firm*—R. Neil Sudol; Henry Coleman; William Sapone

(57) ABSTRACT

A mounting apparatus of a fuel injection valve by which a fuel injection valve can be securely mounted to a fuel distributing pipe with a significantly simple engaging member so as to improve a performance of mounting to a suction pipe and increase a production efficiency. In accordance with the mounting structure of the fuel injection valve, in a state of the fuel introduction cylinder portion (6) of the fuel injection valve (J) being inserted into the fuel introduction cylinder portion guide hole (2) of the fuel distributing pipe (D) and the rear end surface (5A) of the engaging flange portion (5) being brought into contact with the lower end surface (D1) of the fuel distributing pipe (D), the first engaging protrusion (11A) of the engaging member (K) is arranged in such a manner as to be engaged with the first engaging groove (3) of the fuel distributing pipe (D), the fork portion (10) is arranged in such a manner as to be inserted between the opposing flat wall portions (5E, 5F) of the fuel injection valve (J), the second engaging protrusion (13) is arranged in such a manner as to be fitted to the second engaging groove (4) of the fuel distributing pipe (D), and the engaging flange portion (5) of the fuel injection valve (J) is gripped by the lower end surface (D1) of the fuel distributing pipe (D) and the fork portion (10) of the engaging member (K).

2 Claims, 7 Drawing Sheets

MOUNTING APPARATUS OF FUEL INJECTION VALVE

BACKGROUND OF THE INVENTION

1. Field of the Invention

The present invention relates to a fuel injection apparatus which injects and supplies a fuel having a pressure increased by a fuel pump into an engine via a fuel injection valve, and particularly to a mounting apparatus of a fuel injection valve by which the fuel injection valve is detachably mounted to a fuel distributing pipe.

2. Description of the Prior Art

A mounting apparatus of a fuel injection valve in accordance with a conventional art is shown in Japanese Utility Model No. 2535132.

In accordance with the document, a holder having an engaging groove formed on an outer periphery is integrally provided on a fuel distributing pipe, and a first engaging portion pressure-inserted and fitted to the outer periphery of the holder in an elastic manner and engaging with the engaging groove, a second engaging portion engaging with the fuel distributing pipe so as to determine a position of a positioning member itself around an axis, and a third engaging portion engaging with both side surfaces of a coupler so as to determine a position of the fuel injection valve around an axis are integrally formed in the positioning member as a formed product.

The mounting apparatus of the fuel injection valve in accordance with the conventional art has the following disadvantages.

(1) Since a fuel introducing portion of the fuel injection valve is only inserted and arranged within the holder integrally formed on the fuel distributing pipe, the fuel injection valve can be pulled out from the holder in an inserting direction of the fuel injection valve even after the fuel injection valve is positioned by the positioning member.

This is because the positioning member is structured such as to prevent the fuel injection valve from rotating around the axis and does not have a function of preventing the fuel injection valve from moving in an axial direction (a longitudinal direction).

In accordance with the description mentioned above, there is a risk that the fuel injection valve falls off from the fuel distribution pipe at a time of production where the fuel injection valve previously mounted on the fuel distributing pipe in a sub-assembly state is assembled to a suction pipe flowing on an assembly line, so that an effective production can not be achieved.

(2) Since a cylindrical holder is integrally provided in the fuel distributing pipe, it is necessary to prepare the holder independently and it is necessary to adhere the holder to the fuel distributing pipe by means of an adhering means. Accordingly, the number of parts and assembly proceses are increased, and this is not preferable.

(3) The positioning member is fixed to the fuel distributing pipe only by engaging the first engaging portion with the engaging groove of the holder.

That is, the second engaging portion corresponds to means for restricting a rotation of the positioning member, and the third engaging portion corresponds to means for restricting a rotation of the fuel injection valve.

In accordance with the description mentioned above, it is desirable to more securely engage the positioning member with the fuel distributing pipe.

SUMMARY OF THE INVENTION

The present invention is made by taking the disadvantages mentioned above into consideration, and a first aspect of the present invention is to provide a mounting apparatus of a fuel injection valve by which a fuel injection valve can be securely mounted to a fuel distributing pipe with a significantly simple engaging member so as to improve a performance of mounting to a suction pipe and increase a production efficiency.

In order to achieve the object mentioned above, in accordance with a first aspect of the present invention, there is provided a mounting apparatus of a fuel injection valve for a fuel introducing cylinder portion of the fuel injection valve being detachably mounted to the fuel distributing pipe, wherein the fuel distributing pipe comprises:

a fuel passage pierced along a longitudinal direction X—X;

a fuel introduction cylinder portion guide hole communicated with the fuel passage and open to a lower end surface, in a cross section Y—Y perpendicular to the longitudinal direction;

a first engaging groove recessed along a longitudinal direction on one of opposing both side surfaces; and a second engaging groove recessed along a longitudinal direction on another side surface, the fuel injection valve comprises:

a fuel introducing cylinder portion formed from a rear end surface of an engaging flange portion toward a rear end;

an injection cylinder portion formed from a front end surface of the engaging flange portion toward a front end via a connecting cylinder portion provided with a connector portion; and opposing flat wall portions opposing to each other in the connecting cylinder portion extending from the front end surface of the engaging flange portion and having a width B smaller than a diameter A of the engaging flange portion, the engaging member made of an elastic material comprises:

a fork portion to be inserted and arranged in the opposing flat wall portions of the fuel injection valve;

a first engaging protrusion formed in an upper end portion of a first bending piece extending from a base portion of the fork portion toward an upper portion so as to be fitted and arranged in the first engaging groove; and second engaging protrusions formed in respective upper end portions of a third bending piece and a fourth bending piece respectively extending from end portions of a first arm portion and a second arm portion in the fork portion toward upper portions so as to be fitted and arranged in the second engaging groove, and in a state of the fuel introduction cylinder portion of the fuel injection valve being inserted into the fuel introduction cylinder portion guide hole of the fuel distributing pipe and the rear end surface of the engaging flange portion being brought into contact with the lower end surface of the fuel distributing pipe, the first engaging protrusion of the engaging member is arranged in such a manner as to be engaged with the first engaging groove of the fuel distributing pipe, the fork portion is arranged in such a manner as to be inserted between the opposing flat wall portions of the fuel injection valve, the second engaging protrusion is arranged in such a manner as to be fitted to the second engaging groove of the fuel distributing pipe, and the engaging flange portion of the fuel injection valve is gripped by the lower end surface of the fuel distributing pipe and the fork portion of the engaging member.

Further, in accordance with a second aspect of the present invention, there is provided a mounting apparatus of a fuel injection valve as recited in the first aspect, wherein U-shaped bending portions open to a lower portion from the respective upper ends of the third bending piece and the fourth bending piece are integrally formed, and a lead wire of a female type connector portion connected to a connector portion of the fuel injection valve is supported by the U-shaped bending portions.

DESCRIPTION OF THE PREFERRED EMBODIMENT

A description will be given below of an embodiment of a mounting apparatus of a fuel injection valve in accordance with the present invention with reference to the accompanying drawings.

Figure 1:
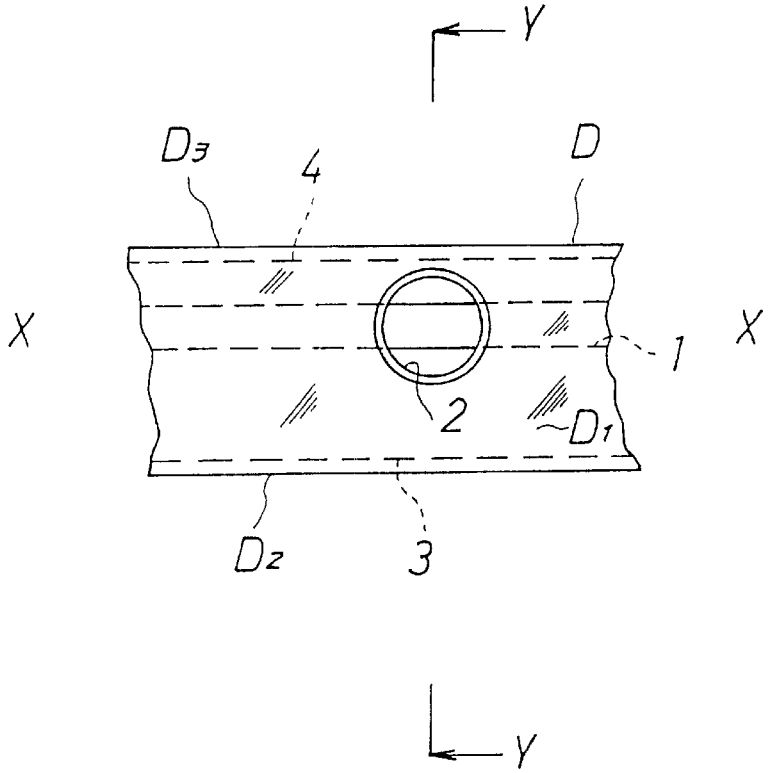
FIG. 1 is a plan view of a lower portion of a fuel distributing pipe.
Figure 2:
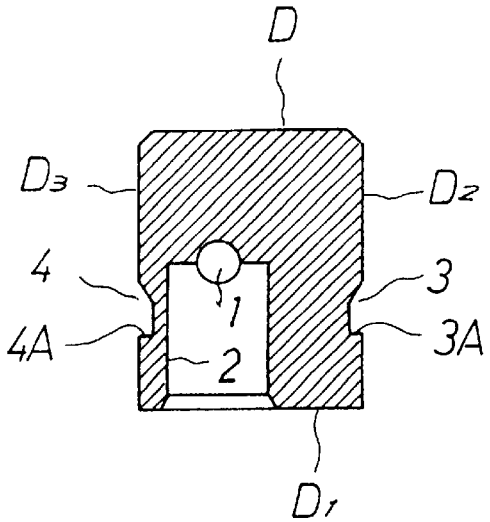
FIG. 2 is a vertical cross sectional view in a line Y—Y in FIG. 1.

A fuel distributing pipe D to which a fuel is supplied from a fuel pump and a fuel injection valve is mounted is shown in FIGS. 1 and 2.

FIG. 1 is a plan view of a lower portion in the case of viewing the fuel distributing pipe D from the lower portion, and FIG. 2 is a vertical cross sectional view in a line Y—Y in FIG. 1.

A fuel passage 1 is pierced along a longitudinal direction X—X within the fuel distributing pipe D, and a fuel having a pressure increased by a fuel pump (not shown) is supplied within the fuel passage 1.

A fuel introduction cylinder portion guide hole 2 communicating with the fuel passage 1 is pierced open on a lower end surface D1 of the fuel distributing pipe D in FIG. 2, a first engaging groove 3 is formed on one side surface D2 among both opposing side surfaces of the fuel distributing pipe D along a longitudinal direction X—X, and a second engaging groove 4 is formed on another side surface D3 along the longitudinal direction X—X.

A first engaging step portion 3A facing to an upper portion is formed in the first engaging groove 3 along the longitudinal direction X—X, and a second engaging step portion 4A facing to an upper portion is formed in the second engaging groove 4 along the longitudinal direction.

The fuel distributing pipe D is manufactured, for example, by an injection molding, a drawing material, a forging or the like, and at this time, the fuel passage 1 and the first and second engaging grooves 3 and 4 including the first engaging step portion 3A and the second engaging step portion 4A can be simultaneously formed.

In this case, the method of manufacturing the passage and the engaging groove is not limited to the manufacturing method mentioned above, and the passage and the engaging groove may be machined.

Figure 3:
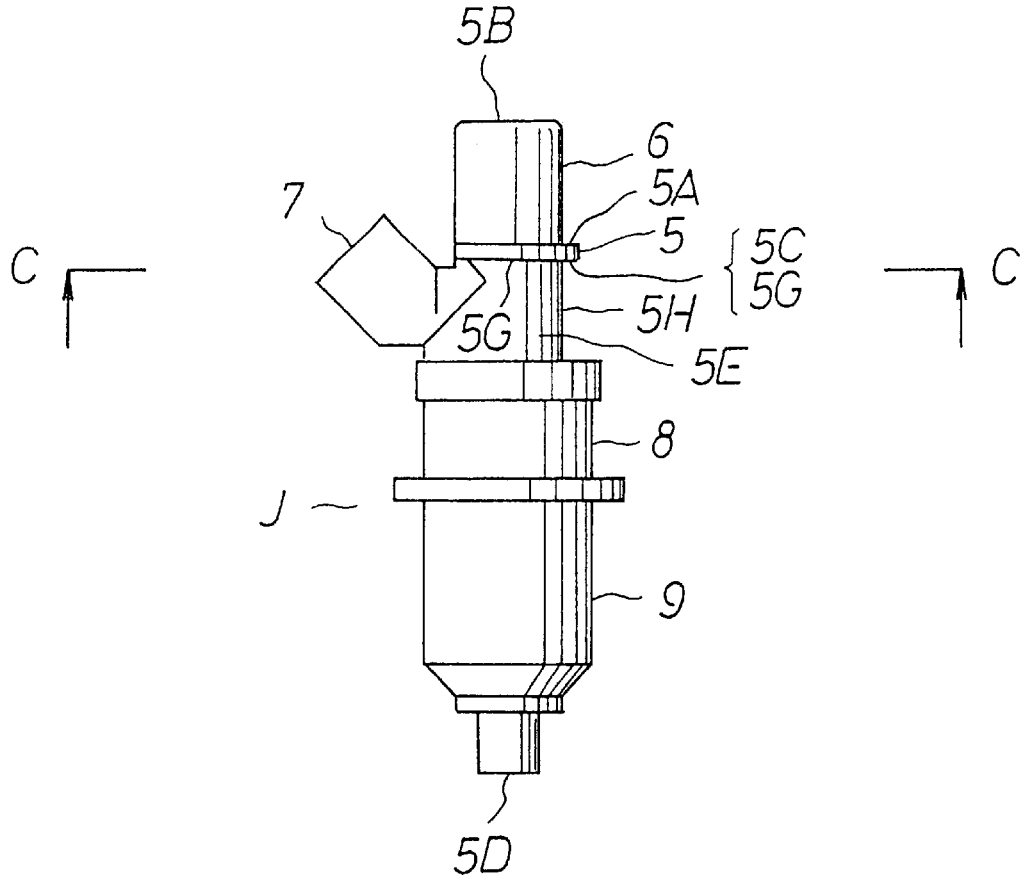
FIG. 3 is a front elevational view of a fuel injection valve.
Figure 4:
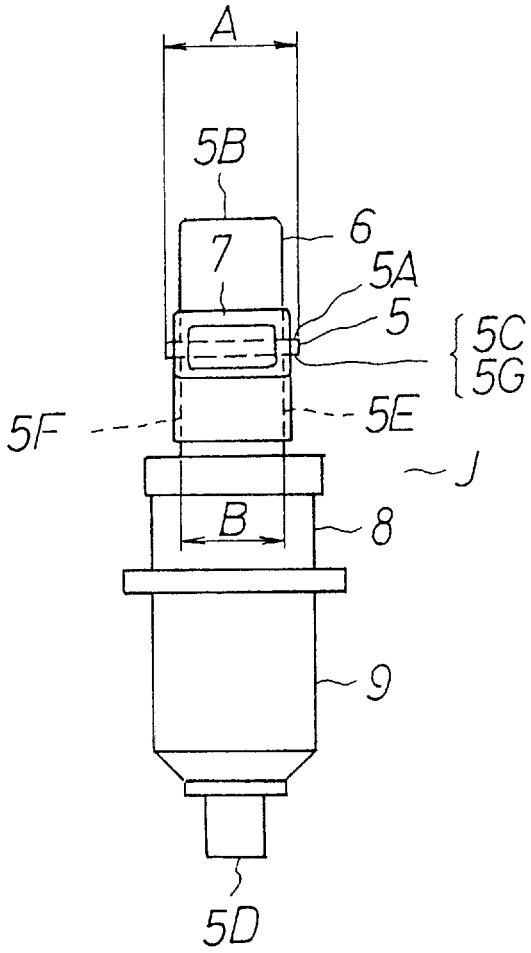
FIG. 4 is a left side elevational view of FIG. 3.
Figure 5:
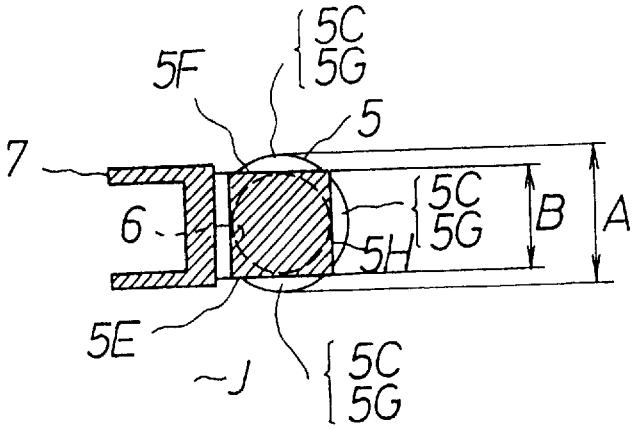
FIG. 5 is a horizontal cross sectional view of a main portion in a line C—C in FIG. 3.

A fuel injection valve J to be mounted to the fuel distributing pipe D is shown in FIGS. 3, 4 and 5.

FIG. 3 is a front elevational view of the fuel injection valve, FIG. 4 is a left side elevational view of FIG. 3, and FIG. 5 is a horizontal cross sectional view of a main portion in a line C—C in FIG. 3.

Reference numeral 5 denotes an engaging flange portion having a diameter A, a fuel introduction cylinder portion 6 is formed from a rear end surface 5A thereof toward a rear end 5B disposed in an upper portion, and a fuel flowing hole (not shown) is open in the rear end 5B of the fuel introduction cylinder portion 6. In this case, an elastic ring for sealing is attached to an outer periphery of the fuel introduction cylinder portion 6, however, it is omitted and not illustrated.

A connection cylinder portion 8 provided with a sideward protruding connector 7 and an injection cylinder portion 9 are continuously provided from a front end surface 5C toward a lower front end 5D in the engaging flange portion 5.

An injection hole (not shown) is open in the front end 5D of the injection cylinder portion 9, and the fuel supplied into the fuel injection valve J via the fuel flowing hole at the rear end is injected and supplied into a suction pipe via the injection hole at the front end.

Further, opposing flat wall portions 5E and 5F opposing to each other are formed on an outer periphery of the connection cylinder portion 8 extending downward from the front end surface 5C of the engaging flange portion 5, and a width B of the opposing flat wall portions 5E and 5F is smaller than the diameter A of the engaging flange portion 5.

This is well shown in FIG. 5, and in accordance with FIG. 5, a pair of crescent-shaped flat surfaces 5G are formed on the front end surface 5C of the engaging flange portion 5 so as to face to the front end 5D. In this case, in the present embodiment, a similar flat wall portion 5H is formed on an outer periphery of the connection cylinder portion 8 opposite to the connector portion 7, whereby the crescent-shaped flat surfaces 5G are formed on the front end surface SC so as to face to the front end 5D. In FIG. 5, since an internal structure of the fuel injection valve J is the same as that of the conventional one, an internal portion of the connection cylinder portion 8 is omitted and expressed by a hatched line.

Figure 6:
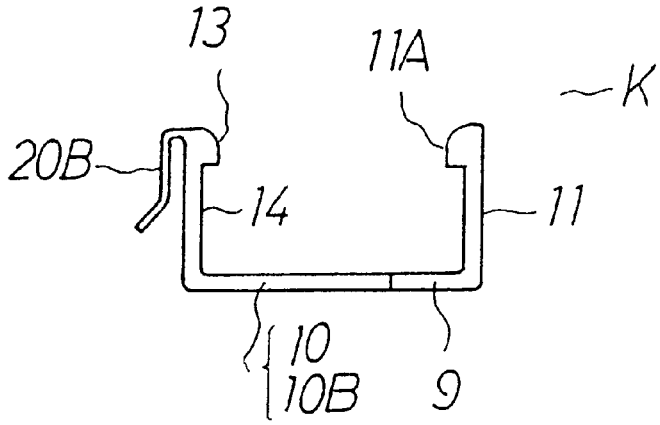
FIG. 6 is a front elevational view of an engaging member.
Figure 7:
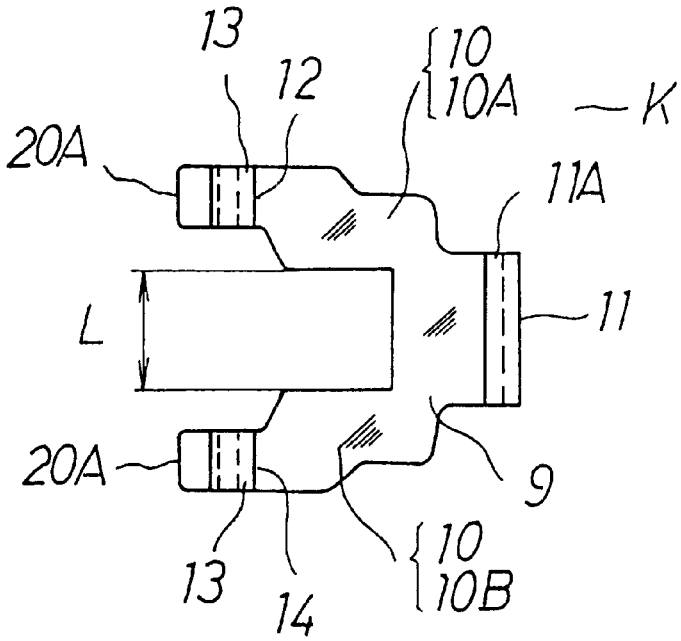
FIG. 7 is a plan view of an upper portion of FIG. 6.
Figure 8:
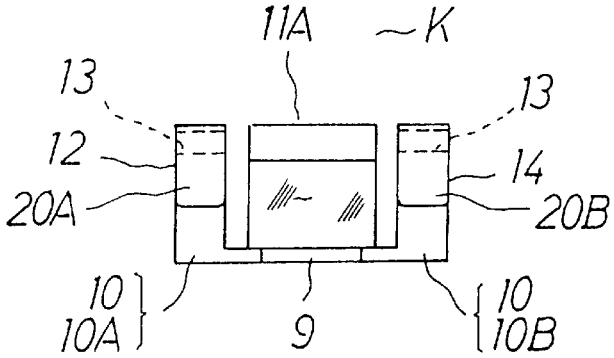
FIG. 8 is a left side elevational view of FIG. 6.

An engaging member K is shown in FIGS. 6, 7 and 8.

FIG. 6 is a front elevational view of the engaging member K, FIG. 7 is a plan view of an upper portion of FIG. 6, and FIG. 8 is a left side elevational view of FIG. 6.

The engaging member K is made of an elastic material such as a synthetic resin material, a spring material or the like.

In FIG. 7, the engaging member K is structured such that a fork portion 10 constituted by a first arm portion 10A and a second arm portion 10B and formed substantially in a flat plate shape is extended from a right base portion 9 toward a left portion, and opposing inner surfaces of the first arm portion 10A and the second arm portion 10B have a width L to be inserted to the opposing flat wall portions 5E and 5F of the fuel injection valve J.

In other words, the inner width L of the fork portion 10 is slightly (for example, 1 mm) larger than the width B of the opposing flat wall portions 5E and 5F.

A first bending piece 11 is formed from a right end of the base portion 9 toward the upper portion, and a first engaging protrusion 11A arranged in such a manner as to be fitted to the first engaging groove 3 and engaged with the first engaging step portion 3A is formed in an upper end portion of the first bending piece 11 in such a manner as to be directed leftward.

Further, a third bending piece 12 is formed from a left end of the first arm portion 10A toward the upper portion, and a second engaging protrusion 13 arranged in such a manner as to be fitted to the second engaging groove 4 and engaged with the second engaging step portion 4A is formed in an upper end portion of the third bending piece 12 in such a manner as to be directed rightward.

Further, a fourth bending piece 14 is formed from a left end of the second arm portion 10B toward the upper portion, and the second engaging protrusion 13 arranged in such a manner as to be fitted to the second engaging groove 4 and engaged with the second engaging step portion 4A is formed in an upper end portion of the fourth bending piece 14 in such a manner as to be directed rightward.

Next, a description will be given below of a mounting operation of the fuel injection valve J to the fuel distributing pipe D in accordance with the present invention.

Figure 9:
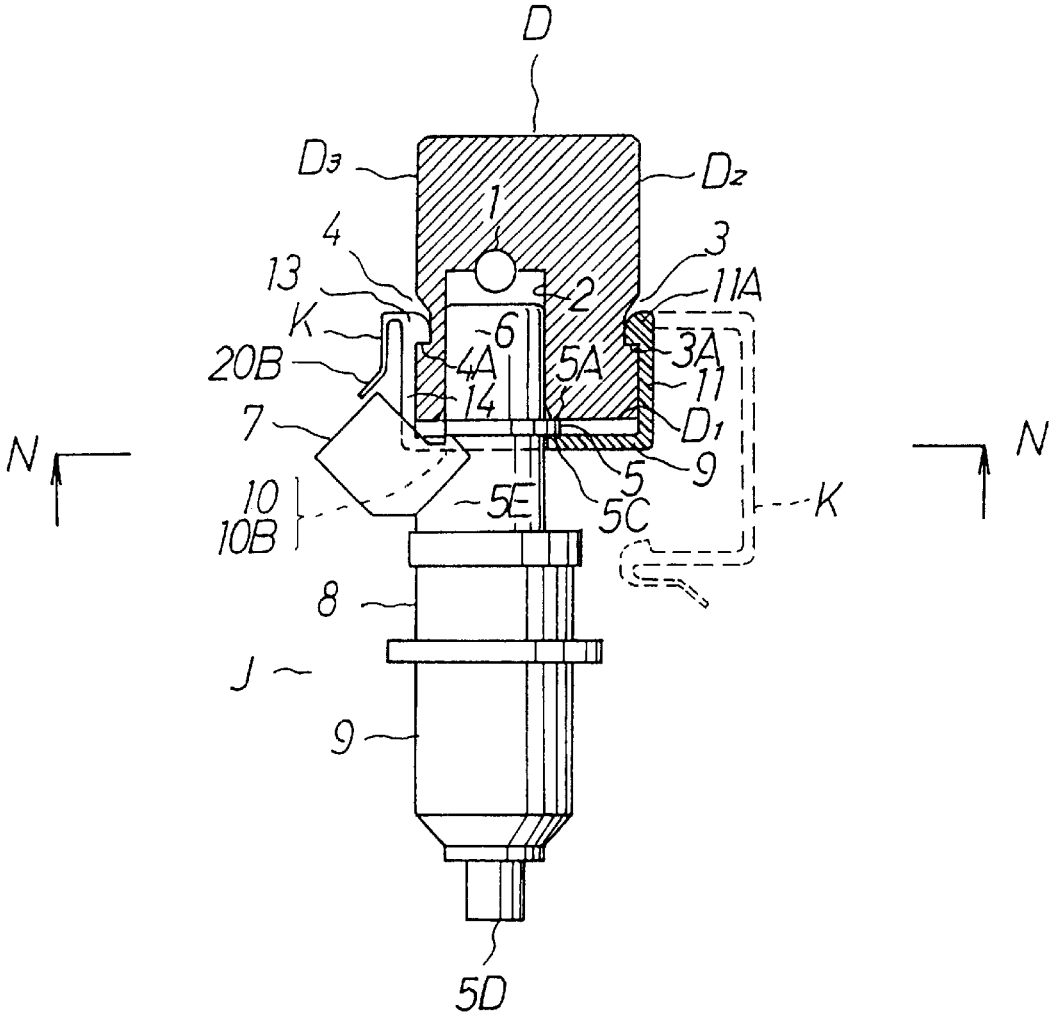
FIG. 9 is a vertical cross sectional view of a main portion which shows a mounting state of the fuel injection valve to the fuel distributing pipe.
Figure 10:
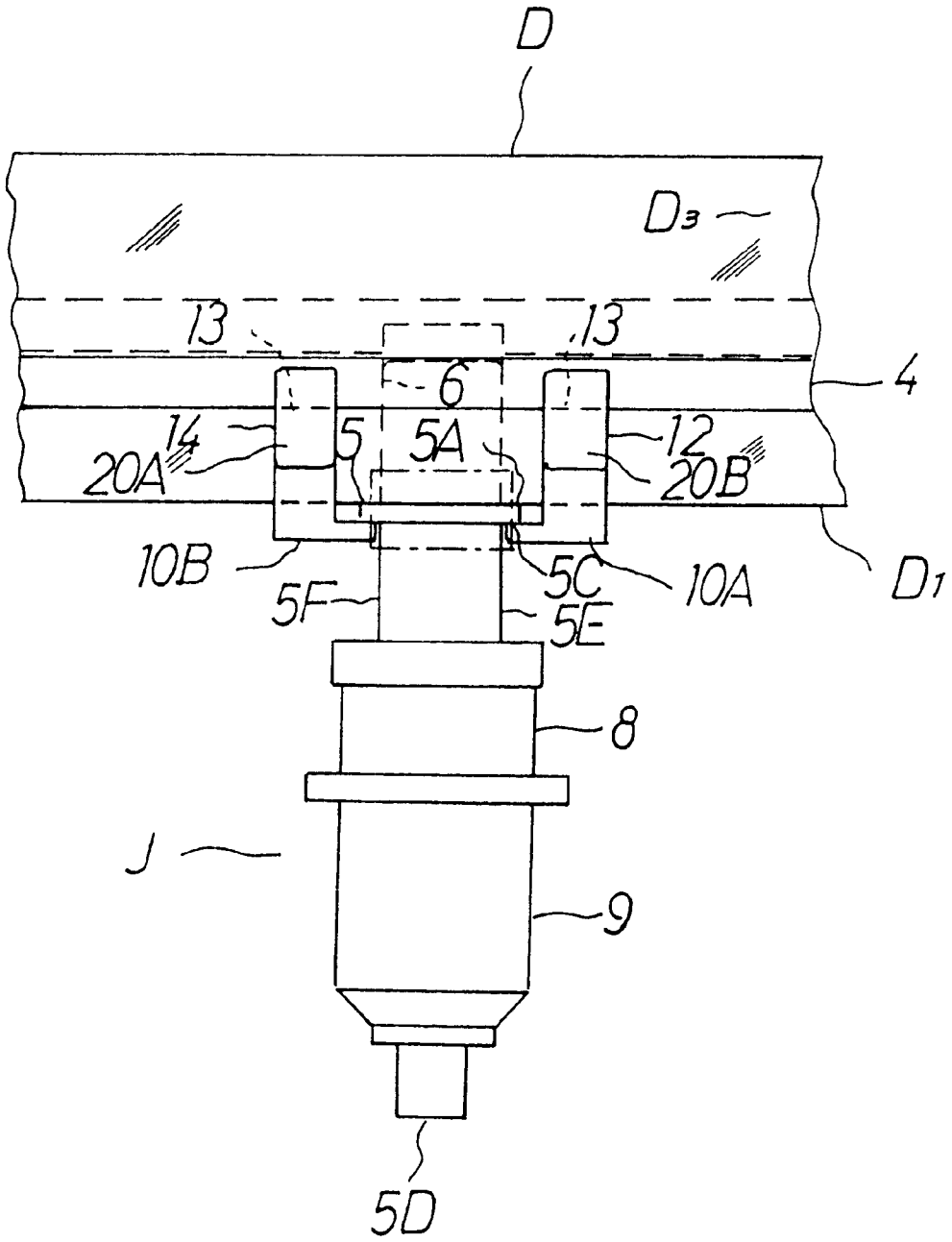
FIG. 10 is a left side elevational view of FIG. 9.
Figure 11:
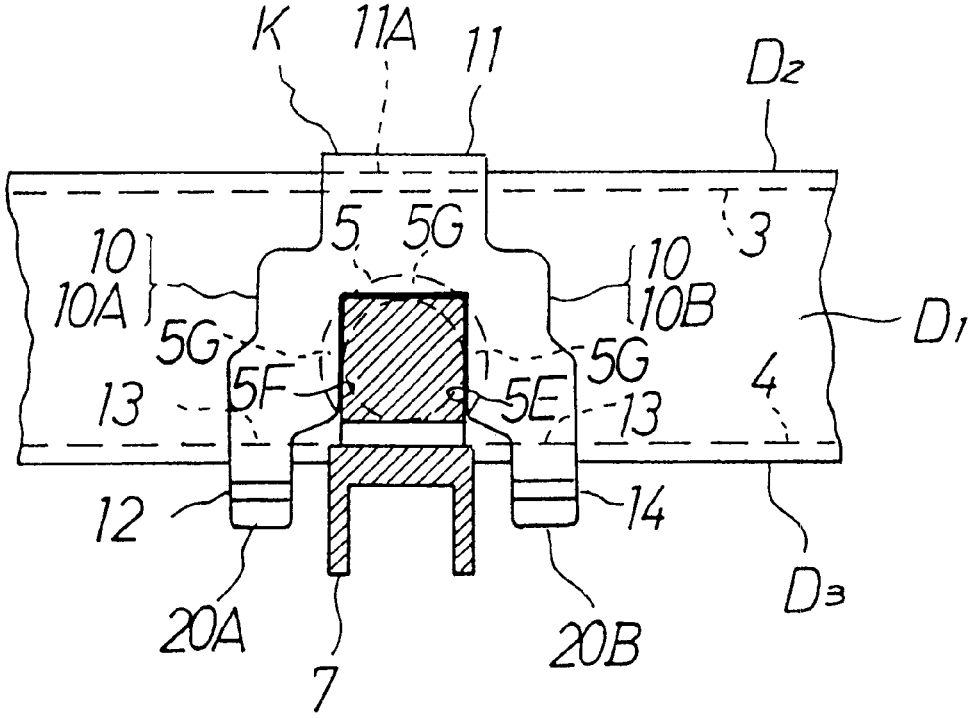
FIG. 11 is a horizontal cross sectional view of a main portion in a line N—N in FIG. 9.

FIG. 9 is a vertical cross sectional view of a main portion in a state that the fuel injection valve is mounted on the fuel distributing pipe and crossed perpendicularly to the longitudinal direction X—X of the fuel distributing pipe, FIG. 10 is a left side elevational view of FIG. 9 (in this case, the connector portion 7 is omitted so as to clearly show the structure), and FIG. 11 is a horizontal cross sectional view of a main portion in a line N—N in FIG. 9.

At first, the fuel introduction cylinder portion 6 of the fuel injection valve J is inserted and arranged into the fuel introduction cylinder portion guide hole 2 from the lower end surface D1 of the fuel distributing pipe D. Accordingly, the rear end surface 5A of the engaging flange portion 5 of the fuel injection valve J is arranged in such a manner as to be brought into contact with the lower end surface D1 of the fuel distributing pipe D.

Secondly, the first engaging protrusion 11A of the engaging member K is engaged with the first engaging groove 3 of the fuel distributing pipe D. This state is shown by a dot line in FIG. 9.

Thirdly, the engaging member K in the second state mentioned above (the state that the first engaging protrusion 11A is engaged with the first engaging groove 3) is rotated in a clockwise direction in FIG. 9 with reference to the first engaging protrusion 11A, thereby engaging the second engaging protrusion 13 of the third bending piece 12 and the second engaging protrusion 13 of the fourth bending piece 14 with the second engaging groove 4 of the fuel distributing pipe D so as to be fitted thereto.

In the operation mentioned above, the first arm portion 10A and the second arm portion 10B corresponding to the fork portion 10 of the engaging member K are not brought into contact with the opposing flat wall portions 5E and 5F of the fuel injection valve J, and can rotate along the opposing flat wall portions 5E and 5F.

This is because the width L of the fork portion 10 is set to be slightly larger than the width B between the opposing flat wall portions 5E and 5F.

In accordance with the structure mentioned above, since the rear end surface 5A of the engaging flange portion 5 of the fuel injection valve J is arranged on the lower end surface D1 of the fuel distributing pipe D, the inner portions of the first arm portion 10A and the second arm portion 10B of the engaging member K are arranged on the crescent-shaped flat surfaces 5G and 5G of the front end surface 5C in the engaging flange portion 5, the first engaging protrusion 11A of the engaging member K is arranged in such a manner as to be engaged with the first engaging step portion 3A of the first engaging groove 3 in the fuel distributing pipe D, and the second engaging protrusion 13 is arranged in such a manner as to be engaged with the second engaging step portion 4A of the second engaging groove 4 in the fuel distributing pipe D, the engaging flange portion 5 is gripped between the lower end surface D1 of the fuel distributing pipe D and the engaging member K so as to be fixed.

Then, since the engaging member K is made of the elastic material, the gripping state mentioned above can be kept by an elastic force.

As mentioned above, in accordance with the present invention, since the crescent-shaped flat surface 5G of the rear end surface 5C of the engaging flange portion 5 in the fuel injection valve J is brought into contact with the inner surface of the fork portion 10 of the engaging member K and held therein, the fuel introduction cylinder portion 6 of the fuel injection valve J is prevented from coming out from the fuel introduction cylinder portion guide hole 2 of the fuel distributing pipe D, and on the other hand, since the opposing flat wall portions 5E and 5F of the fuel injection valve J are brought into contact with the inner wall of the fork portion 10 of the engaging member K, the fuel injection valve J is prevented from rotating around the axis.

Next, by forming the U-shaped bending portions 20A and 20B open toward the lower portion from the upper end of the third bending piece 12 and the fourth bending piece 14 in the engaging member K, it is possible to securely support each of the lead wires extending from a female type connector portion (not shown) toward the outer portion by the U-shaped bending portions 20A and 20B after fitting the female type connector portion to the connector portion 7 of the fuel injecting valve J, whereby it is not necessary to prepare a special supporting member with respect to a support of the lead wires.

As mentioned above, in accordance with the mounting apparatus of the fuel injection valve of the present invention, since it the possible to prevent the fuel injection valve from moving in the direction of the axis and rotating around the axis in a state of the fuel injection valve being attached to the fuel distributing pipe by the engaging member, it is possible to securely sub-assemble the fuel injection valve with the fuel distributing pipe, thereby improving a performance of mounting to the suction pipe and widely increasing a production efficiency.

Further, in accordance with the present invention, since the fuel injection valve and the fuel distributing pipe are attached to each other only by the engaging member, the number of the parts and assembly processes are not increased. Further, since the engaging member is structured such that both ends thereof are engaged by the first and second engaging grooves of the fuel distributing pipe, it is possible to further securely support the fuel injection valve.

Further, since the lead wires of the female connector portion are supported by the U-shaped type bending portion, it is possible to securely support the lead wires without using any special supporting member.

What is claimed is:

1. A mounting apparatus of a fuel injection valve for a fuel introducing cylinder portion of the fuel injection valve being detachably mounted to the fuel distributing pipe, wherein the fuel distributing pipe (D) comprises:

a fuel passage (1) pierced along a longitudinal direction X—X;

a fuel introduction cylinder portion guide hole (2) communicated with the fuel passage (1) and open to a lower end surface (D1), in a cross section Y—Y perpendicular to the longitudinal direction X—X;

a first engaging groove (3) recessed along a longitudinal direction on one (D2) of opposing both side surfaces; and a second engaging groove (4) recessed along a longitudinal direction on another side surface (D3), the fuel injection valve (J) comprises:

a fuel introducing cylinder portion (6) formed from a rear end surface (5A) of an engaging flange portion (5) toward a rear end (5B);

an injection cylinder portion (9) formed from a front end surface (5C) of the engaging flange portion (5) toward a front end (5D) via a connecting cylinder portion (8) provided with a connector portion (9); and opposing flat wall portions (5E, 5F) opposing to each other in the connecting cylinder portion (8) extending from the front end surface (5C) of the engaging flange portion (5) and having a width B smaller than a diameter A of the engaging flange portion (5), the engaging member (K) made of an elastic material comprises:

a fork portion (10) to be inserted and arranged in the opposing flat wall portions (5E, 5F) of the fuel injection valve (J);

a first engaging protrusion (11A) formed in an upper end portion of a first bending piece (11) extending from a base portion (9) of the fork portion (10) toward an upper portion so as to be fitted and arranged in the first engaging groove (3); and second engaging protrusions (13) formed in respective upper end portions of a third bending piece (12) and a fourth bending piece (14) respectively extending from end portions of a first arm portion (10A) and a second arm portion (10B) in the fork portion (10) toward upper portions so as to be fitted and arranged in the second engaging groove (4), and in a state of the fuel introduction cylinder portion (6) of the fuel injection valve (J) being inserted into the fuel introduction cylinder portion guide hole (2) of the fuel distributing pipe (D) and the rear end surface (5A) of the engaging flange portion (5) being brought into contact with the lower end surface (D1) of the fuel distributing pipe (D), the first engaging protrusion (11A) of the engaging member (K) is arranged in such a manner as to be engaged with the first engaging groove (3) of the fuel distributing pipe (D), the fork portion (10) is arranged in such a manner as to be inserted between the opposing flat wall portions (5E, 5F) of the fuel injection valve (J), the second engaging protrusion (13) is arranged in such a manner as to be fitted to the second engaging groove (4) of the fuel distributing pipe (D), and the engaging flange portion (5) of the fuel injection valve (J) is gripped by the lower end surface (D1) of the fuel distributing pipe (D) and the fork portion (10) of the engaging member (K).

2. Amounting apparatus of a fuel injection valve as claimed in claim 1, wherein U-shaped bending portions (20A, 20B) open to a lower portion from the respective upper ends of said third bending piece (12) and said fourth bending piece (14) are integrally formed, and a lead wire of a female type connector portion connected to a connector portion (7) of the fuel injection valve (J) is supported by said U-shaped bending portions (20A, 20B).

* * * * *